US006655928B2

(12) United States Patent
Chou

(10) Patent No.: US 6,655,928 B2
(45) Date of Patent: Dec. 2, 2003

(54) AIR COMPRESSOR ASSEMBLY HAVING DIFFERENT MOTORS

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 36 days.

(21) Appl. No.: 10/055,193

(22) Filed: Jan. 25, 2002

(65) Prior Publication Data

US 2003/0140729 A1 Jul. 31, 2003

(51) Int. Cl.[7] ..... F04B 17/00; F04B 35/04
(52) U.S. Cl. ..... 417/360; 417/415
(58) Field of Search ..... 417/360, 361, 417/415

(56) References Cited

U.S. PATENT DOCUMENTS 6,036,452 A * 3/2000 Huang ..... 417/360
6,146,112 A * 11/2000 Chou ..... 417/360
6,152,704 A * 11/2000 Aboul-Hosn et al. ..... 417/360
6,280,163 B1 * 8/2001 Chou ..... 417/550
6,315,534 B1 * 11/2001 Chou ..... 417/550

* cited by examiner

*Primary Examiner*—Charles G. Freay
(74) *Attorney, Agent, or Firm*—Charles E. Baxley

(57) ABSTRACT

An air compressor includes a cylinder attached to the base, two or more motors selectively secured to the base and each having a spindle extended through the base. The motors may include different driving powers or different diameters. Two coupling devices may couple the spindles of the motors to the cylinder respectively. A smaller motor includes a pinion secured to the spindle and engaged with a gear, and a weight is secured to the gear and coupled to the cylinder. The spindle of a greater motor may be secured to the weight which is then secured or coupled to the cylinder.

19 Claims, 8 Drawing Sheets

AIR COMPRESSOR ASSEMBLY HAVING DIFFERENT MOTORS

BACKGROUND OF THE INVENTION

1. Field of the Invention

The present invention relates to an air compressor, and more particularly to an air compressor assembly having two or more motors of different powers or diameters selectively attachable to the base thereof.

2. Description of the Prior Art

Typical air compressors comprise a cylinder attached or secured to a base, and a motor secured to the base and coupled to the cylinder for actuating or driving the cylinder. The applicant has developed various kinds of air compressors, one of which has been issued as U.S. Pat. No. 6,146,112 to Chou, and also includes a single motor secured to the base for driving the cylinder. The cylinder may not be driven by another motor of different driving power or of different diameter. Another set of air compressor is further required and also includes a cylinder and a motor secured to the base and coupled together for allowing the cylinder to be actuated or driven by the other motor of different driving power or of different diameter.

The present invention has arisen to mitigate and/or obviate the afore-described disadvantages of the conventional air compressors.

SUMMARY OF THE INVENTION

The primary objective of the present invention is to provide an air compressor assembly including two or more motors of different powers or diameters that may be selectively attachable to the base for providing different driving powers to the air compressor assembly.

In accordance with one aspect of the invention, there is provided an air compressor assembly comprising a base including an upper portion and a lower portion, a cylinder attached to the base, a first motor secured to the upper portion of the base and including a spindle extended through the upper portion of the base, a first coupling means for coupling the spindle of the first motor to the cylinder, a second motor selectively secured to the lower portion of the base and including a spindle extended through the lower portion of the base, and a second coupling means for selectively coupling the spindle of the second motor to the cylinder. The motors may include different driving powers or different diameters for selectively actuating or driving the cylinder with different driving powers.

The first coupling means includes a pinion secured to the spindle of the first motor, a gear engaged with the pinion, a weight secured to the gear and rotated in concert with the gear and coupled to the cylinder. The weight may be rotatably secured to the base.

The cylinder includes a piston rod, the weight includes a shaft rotatably secured to the base, and includes an eccentric pin secured to the piston rod of the cylinder.

The base includes an opening formed therein, and a bearing engaged in the opening of the base, the shaft of the weight is secured to the bearing.

The base includes a peripheral flange extended outward therefrom and provided around the opening thereof, and foldable relative to the base for engaging with the bearing and for retaining the bearing in the opening of the base.

The second coupling means includes a weight secured to the spindle of the second motor and having an eccentric pin secured to the piston rod of the cylinder.

The upper portion of the base includes an aperture formed therein and at least one pair of first holes formed around the aperture of the base for selectively securing the second motor to the upper portion of the base, the lower portion of the base includes an orifice formed therein and at least one pair of second holes formed around the orifice of the base for selectively securing the first motor to the lower portion of the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
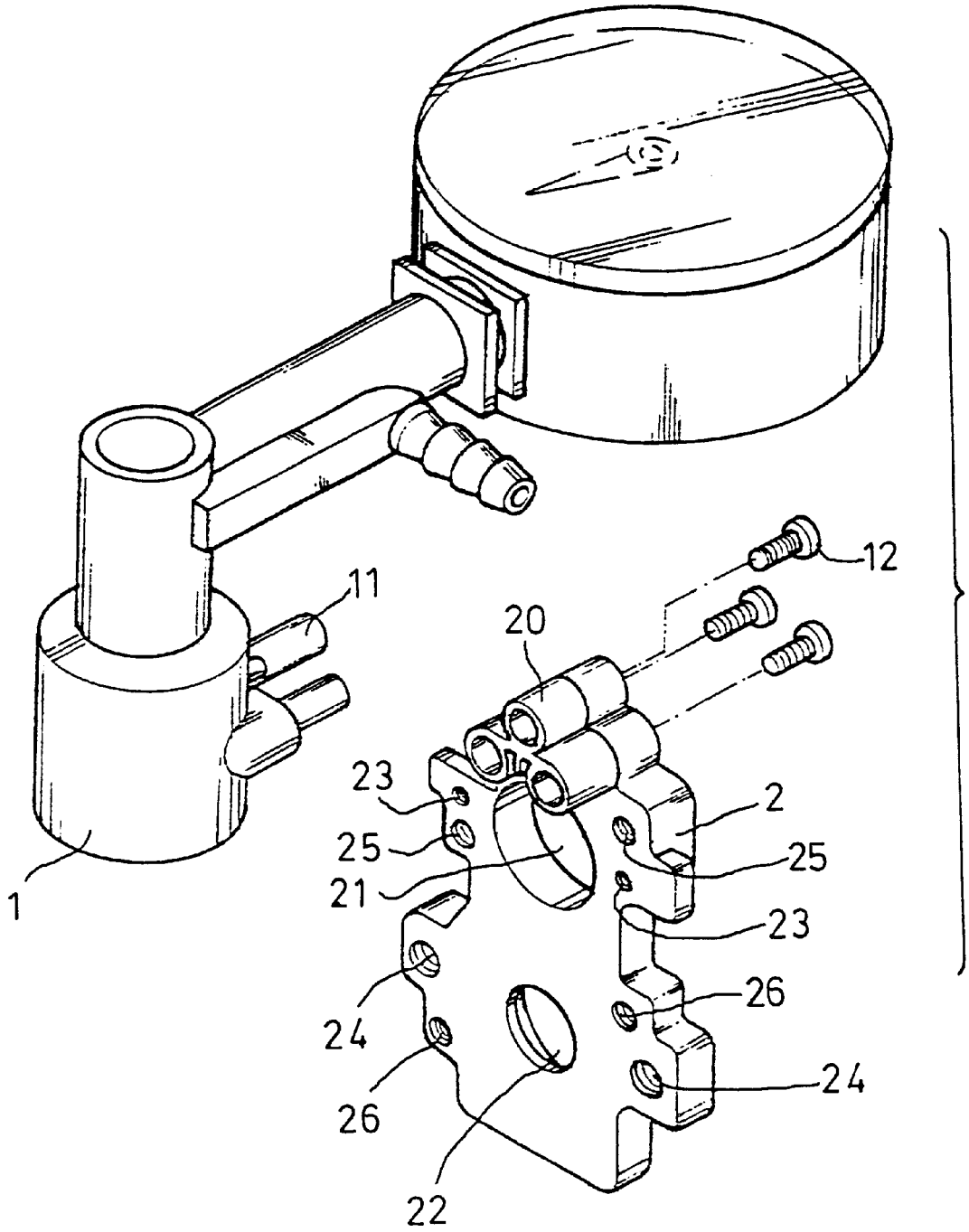
FIG. 1 is a partial exploded view of an air compressor assembly in accordance with the present invention.
Figure 2:
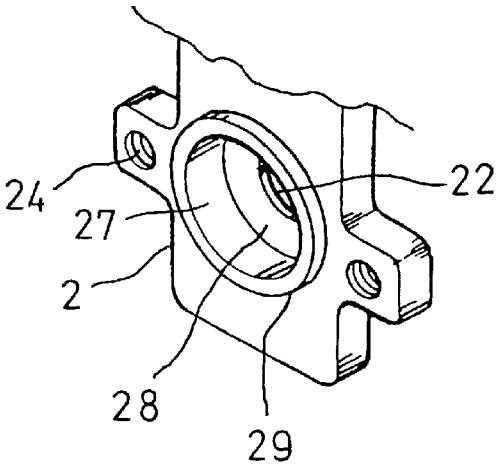
FIG. 2 is a rear partial perspective view showing a base of the air compressor assembly.
Figure 3:
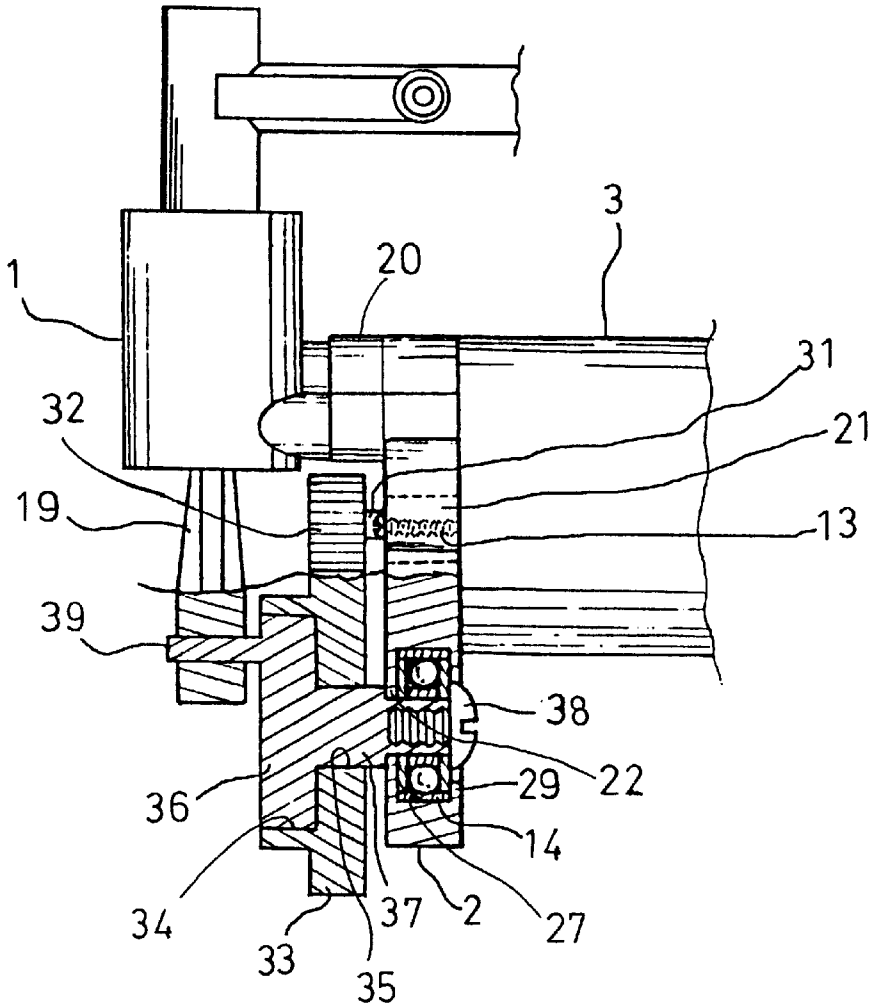
FIG. 3 is a partial cross sectional view of the air compressor assembly.
Figure 9:
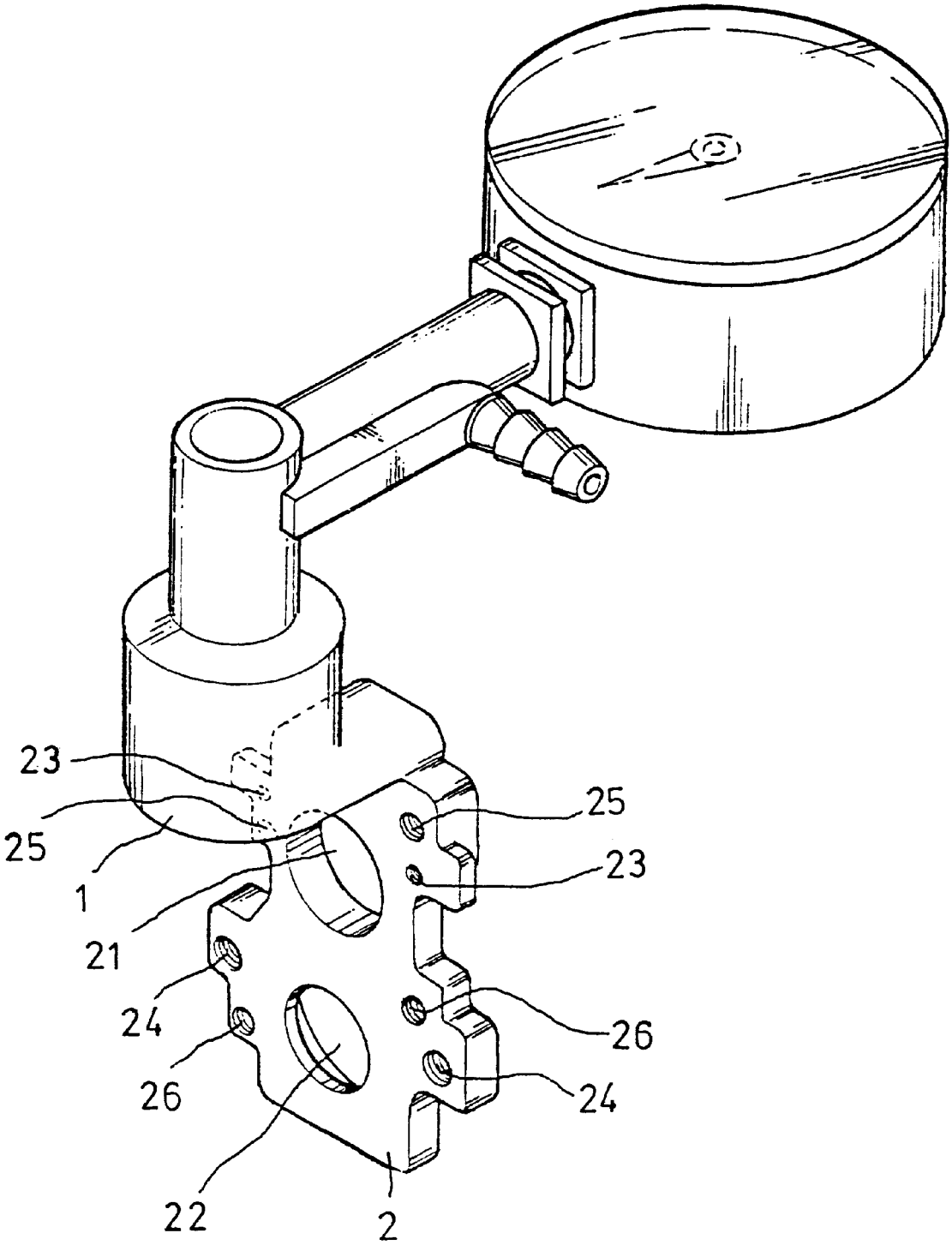
FIG. 9 is a perspective view illustrating a further embodiment of the air compressor assembly.

Referring to the drawings, and initially to FIGS. 1–3, an air compressor assembly in accordance with the present invention comprises a housing or a cylinder 1 including one or more extensions 11 extended therefrom, and a base 2 including one or more barrels 20 engaged into or onto and secured to the extensions 11 of the cylinder 1 respectively with fasteners 12. Alternatively, as shown in FIG. 9, the cylinder 1 may also be solidly secured to or formed as a one-integral-piece with the base 2. The base 2 includes an aperture 21 formed in the upper portion thereof, an orifice 22 formed in the lower and front portion thereof, and an opening 27 (FIG. 2) formed in the lower and rear portion thereof and communicating with the orifice 22 thereof, for forming or defining a peripheral shoulder 28 therein. The base 2 includes a peripheral flange 29 extended rearward therefrom and provided around the opening 27 thereof.

Figure 10:
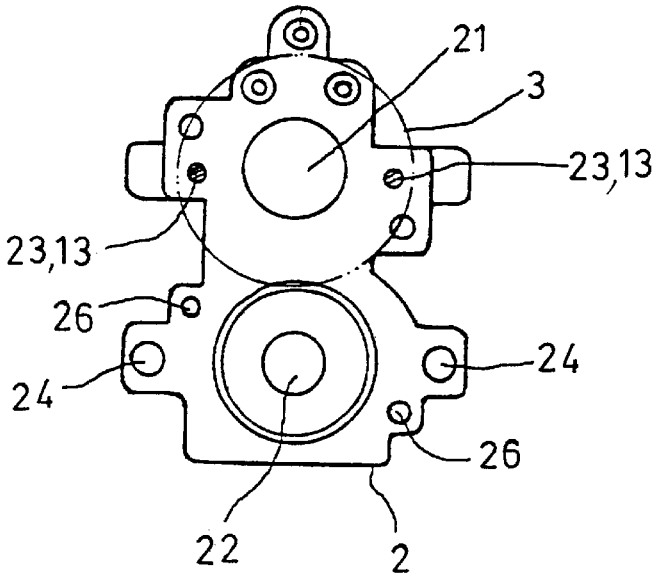
FIGS. 10, 11, 12, 13 are plan schematic views illustrating the attachment of different motors to the base of the air compressor assembly.

A motor 3 is secured to the upper portion of the base 2 with such as the fasteners 13, and includes a spindle 31 extended through the aperture 21 of the base 2, and includes a pinion 32 secured to the spindle 31 thereof. The fasteners 13 may engage through the holes or screw holes 23 of the base 2 and may be secured to the motor 3 (FIG. 10). A gear 33 is engaged with the pinion 32 and includes a chamber 34 and a hole 35 of different diameters formed therein and communicating with each other. A bearing 14 (FIG. 3) is engaged or secured in the opening 27 of the base 2. A weight 36 is received or secured in the chamber 34 of the gear 33 and rotated in concert with the gear 33, and includes a shaft 37 engaged through the hole 35 of the gear 33 and engaged into and secured to the bearing 14 with such as a fastener 38, such that the shaft 37 and thus the weight 36 and the gear 33 may be smoothly and rotatably secured to the base 2. The weight 36 includes a crank or an eccentric pin 39 extended therefrom and coupled to a piston rod 19 of the cylinder 1 (FIGS. 3–5).

Figure 4:
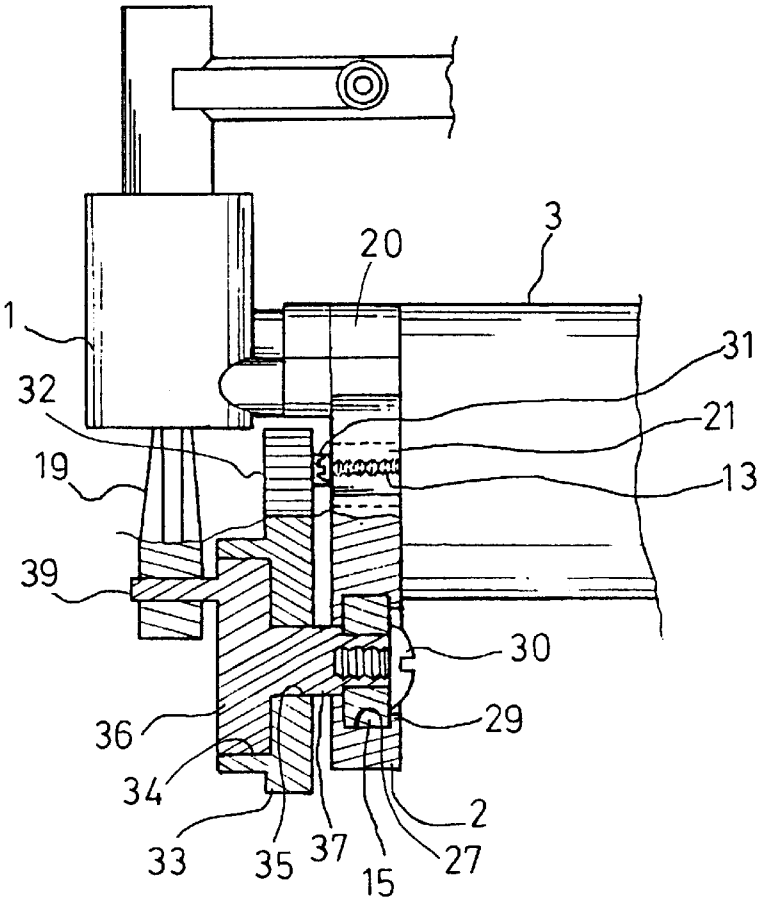
FIG. 4 is a partial cross sectional view similar to FIG. 3, illustrating the other embodiment of the air compressor assembly.

Alternatively, as shown in FIG. 4, the shaft 37 of the weight 36 may be rotatably secured to the base 2 with a gasket 15 or the like. The peripheral flange 29 of the base 2 may be folded or forged to engage with the bearing 14 (FIG. 3) or the gasket 15 (FIG. 4), for stably retaining the bearing 14 or the gasket 15 within the opening 27 of the base 2, and for preventing the bearing 14 or the gasket 15 from being disengaged from the opening 27 of the base 2. The piston rod 19 of the cylinder 1 may thus be actuated or driven by the motor 3 via the pinion 32 and the gear 33 and the weight 36.

Figure 8:
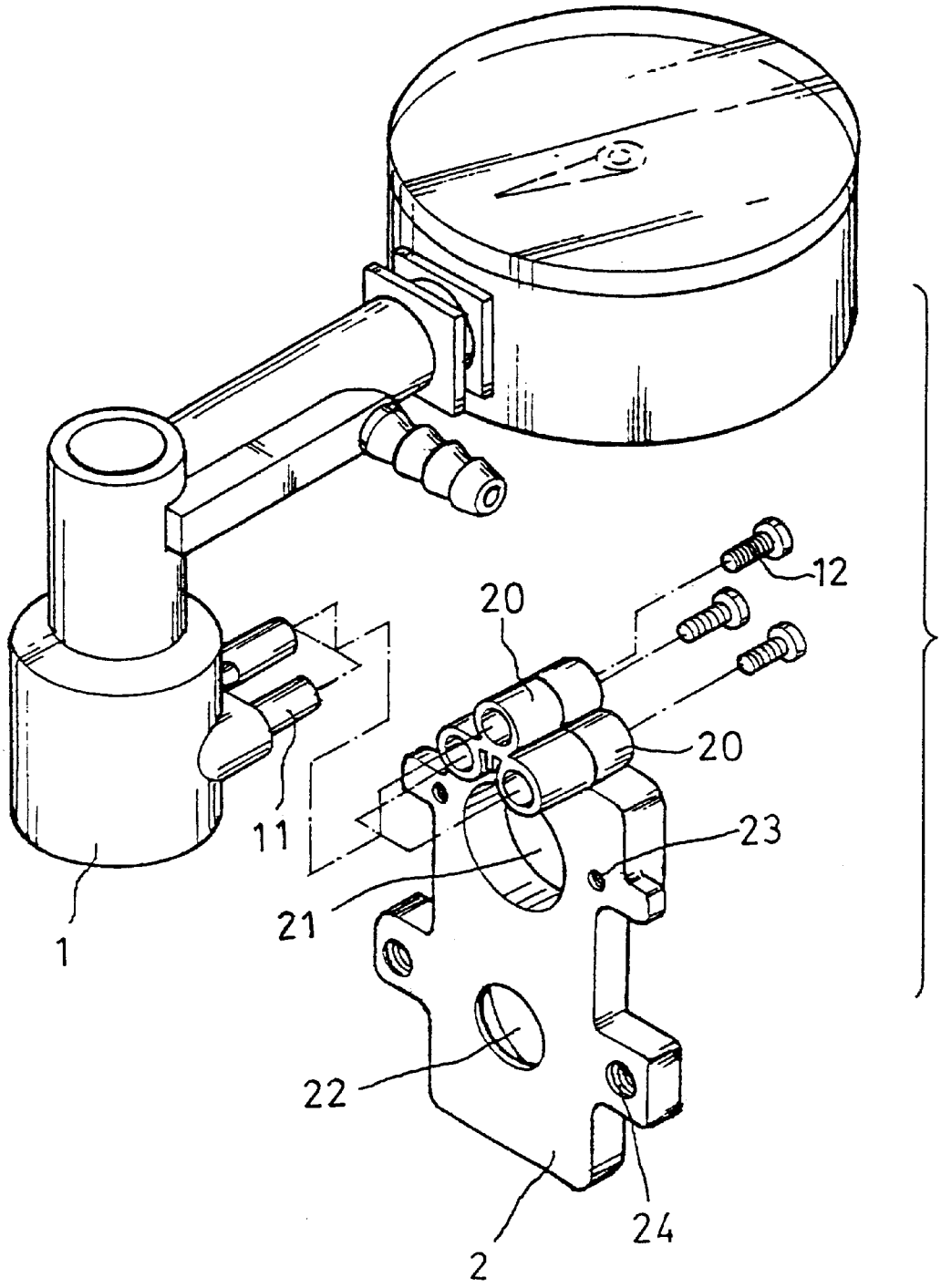
FIG. 8 is a partial exploded view similar to FIG. 1, illustrating the other embodiment of the air compressor assembly.

As best shown in FIGS. 1 and 10–13, the base 2 may include one or more pairs of holes or screw holes 23, 25 formed or provided around the aperture 21 thereof, and may include one or more pairs of holes or screw holes 24, 26 formed or provided around the orifice 22 thereof, for allowing the motors of different powers or diameters to be selectively attached to the base and coupled to the cylinder 1 for providing different driving powers to the cylinder 1. Alternatively, as shown in FIG. 8, the base 2 may include only one pair of holes or screw holes 23 formed or provided around or beside the aperture 21 thereof, and may include only one pair of holes or screw holes 24 formed or provided around or beside the orifice 22 thereof.

Figure 5:
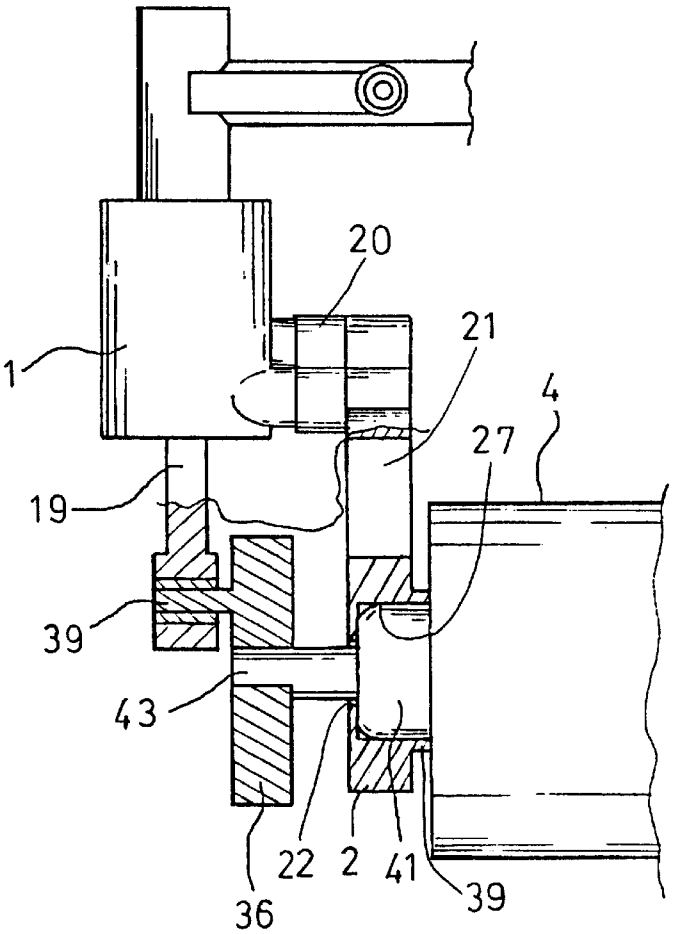
FIG. 5 is a partial cross sectional view illustrating the attachment of the other motor to the base of the air compressor assembly.
Figure 6:
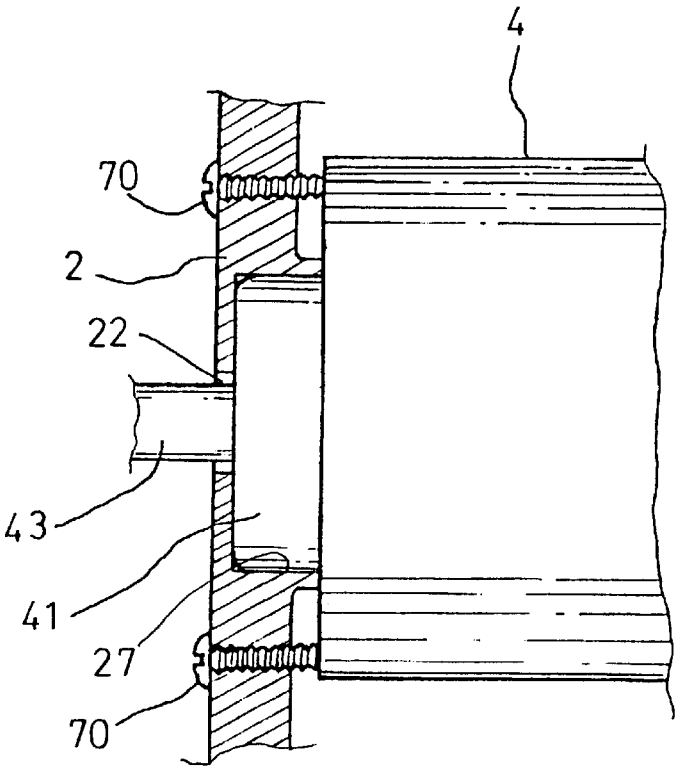
FIGS. 6, 7 are enlarged partial cross sectional views illustrating the attachment of different motors to the base of the air compressor assembly.
Figure 13:
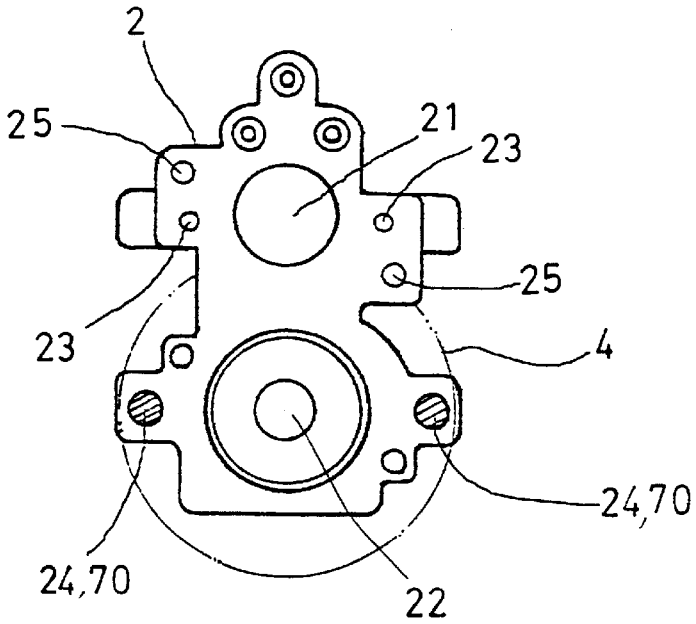

Referring next to FIGS. 5 and 6, another motor 4 includes a greater power or a greater diameter than that of the motor 3, and is secured to the lower portion of the base 2 with such as the fasteners 70, and includes a hub 41 secured or engaged in the opening 27 of the base 2, and includes a spindle 43 extended from the hub 41 and extended outward through the orifice 22 of the base 2. The fasteners 70 may engage through the holes or screw holes 24 of the base 2 and may be secured to the motor 4 (FIG. 13). The weight 36 is secured to the spindle 43 of the motor 4 with such as a key, a fastener, a latch or the like, and includes a crank or an eccentric pin 39 extended therefrom and coupled to the piston rod 19 of the cylinder 1 (FIGS. 3–5), such that the motor 4 of different power or of different diameter may be selectively secured to the base 2 and coupled to the cylinder 1 and such that the cylinder 1 may also be actuated or driven by the motor 4 via the spindle 43 and the weight 36.

Figure 7:
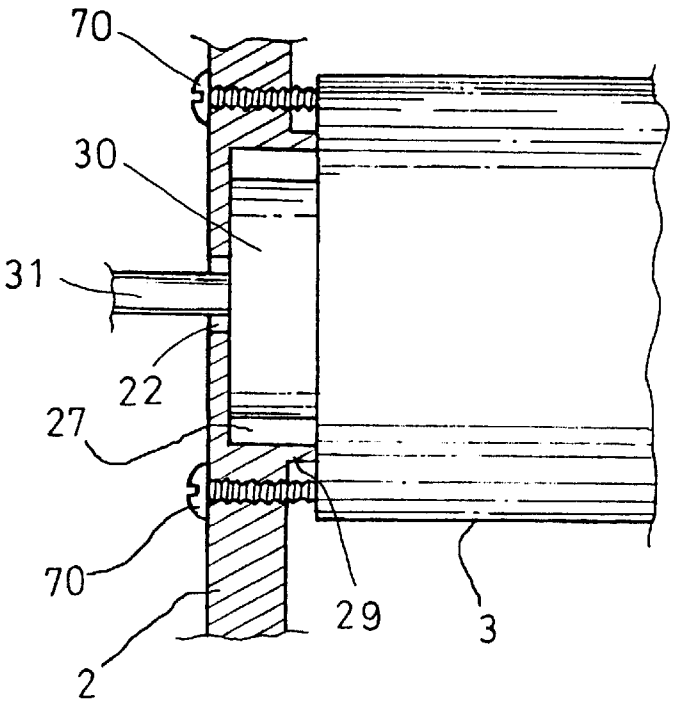
Figure 11:
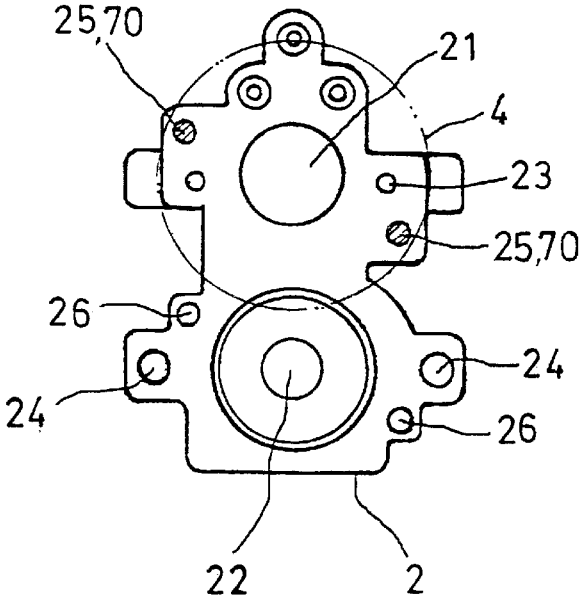
Figure 12:
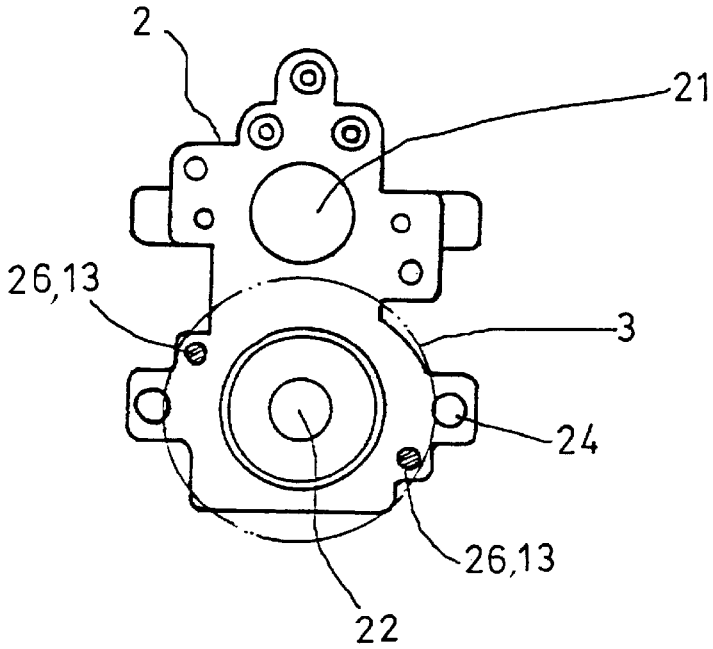

As shown in FIGS. 7 and 12, the motor 3 includes such as a smaller diameter than that of the motor 4 and includes a hub 30 of a smaller diameter than that of the hub 41 of the motor 4. The hub 30 of the motor 3 may also be engaged into the opening 27 of the base 2 and the spindle 31 of the motor 3 may also be extended outward through the orifice 22 of the base 2 for securing to the weight 36 and for selectively driving the cylinder 1. The motor 3 may be secured to the base 2 with the fasteners 13 (FIG. 12) which may engage through the holes or screw holes 26 of the base 2 and may be secured to the motor 3. Referring next to FIG. 11, the motor 4 of a greater diameter than that of the motor 3 may also be secured to the upper portion of the base 2 with such as the fasteners 70 which may engage through the holes or screw holes 25 of the base 2 and may be secured to the motor 4 (FIG. 11).

In operation, as shown in FIGS. 3, 4, 10, the smaller motor 3 may be secured to the upper portion of the base 2, or may be secured to the lower portion of the base 2 (FIG. 12), for selectively driving the cylinder 1. As shown in FIGS. 5, 6, 13, the greater motor 4 may be secured to the lower portion of the base 2, or may be secured to the upper portion of the base 2 (FIG. 11), for selectively driving the cylinder 1. Two or more motors 3, 4 may be selectively secured to the same base 2 and coupled to the same cylinder 1, for providing different driving powers to the cylinder 1, and for allowing the users to have different powers of cylinder 1 with less parts or elements and with less expenses or costs.

Accordingly, the air compressor assembly in accordance with the present invention includes two or more motors of different powers or diameters that may be selectively attachable to the base for providing different driving powers to the air compressor assembly.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor assembly comprising:

a base, a cylinder attached to said base, a first motor selectively secured to said base and including a spindle extended through said base, a first coupling means for selectively coupling said spindle of said first motor to said cylinder, a second motor selectively secured to said base and including a spindle extended through said base, and a second coupling means for selectively coupling said spindle of said second motor to said cylinder.

2. The air compressor assembly according to claim 1, wherein said first coupling means includes a pinion secured to said spindle of said first motor, a gear engaged with said pinion, a weight secured to said gear and rotated in concert with said gear and coupled to said cylinder.

3. The air compressor assembly according to claim 2, further comprising a piston slidably received in said cylinder and connected to a piston rod, said weight includes a shaft rotatably secured to said base, and includes an eccentric pin secured to said piston rod.

4. The air compressor assembly according to claim 3, wherein said base includes an opening formed therein, and a bearing engaged in said opening thereof, said shaft of said weight is secured to said bearing.

5. The air compressor assembly according to claim 4, wherein said base includes a peripheral flange extended outward therefrom and provided around said opening thereof, and foldable relative to said base for engaging with said bearing and for retaining said bearing in said opening of said base.

6. The air compressor assembly according to claim 1, further comprising a piston slidably received in said cylinder and connected to a piston rod, said second coupling means includes a weight secured to said spindle of said second motor and having an eccentric pin secured to said piston rod.

7. An air compressor assembly comprising:

a base including an aperture and an orifice formed therein, a cylinder attached to said base, a first motor selectively secured to said base and including a spindle extended through said aperture of said base, a first coupling means for selectively coupling said spindle of said first motor to said cylinder, a second motor selectively secured to said base and including a spindle extended through said orifice of said base, and a second coupling means for selectively coupling said spindle of said second motor to said cylinder.

8. The air compressor assembly according to claim 7, wherein said first coupling means includes a pinion secured to said spindle of said first motor, a gear engaged with said pinion, a weight secured to said gear and rotated in concert with said gear and coupled to said cylinder.

9. The air compressor assembly according to claim 8, further comprising a piston slidably received in said cylinder and connected to a piston rod, said weight includes a shaft rotatably secured to said base, and includes an eccentric pin secured to said piston rod.

10. The air compressor assembly according to claim 9, wherein said base includes an opening formed therein and communicating with said orifice thereof, and a bearing engaged in said opening thereof, said shaft of said weight is secured to said bearing.

11. The air compressor assembly according to claim 10, wherein said base includes a peripheral flange extended outward therefrom and provided around said opening thereof, and foldable relative to said base for engaging with said bearing and for retaining said bearing in said opening of said base.

12. The air compressor assembly according to claim 7, further comprising a piston slidably received in said cylinder and connected to a piston rod, said second coupling means includes a weight secured to said spindle of said second motor and having an eccentric pin secured to said piston rod.

13. An air compressor assembly comprising:

a base including an upper portion and a lower portion, a cylinder attached to said base, a first motor selectively secured to said upper portion of said base and including a spindle extended through said upper portion of said base, a first coupling means for selectively coupling said spindle of said first motor to said cylinder, a second motor selectively secured to said lower portion of said base and including a spindle extended through said lower portion of said base, and a second coupling means for selectively coupling said spindle of said second motor to said cylinder.

14. The air compressor assembly according to claim 13, wherein said first coupling means includes a pinion secured to said spindle of said first motor, a gear engaged with said pinion, a weight secured to said gear and rotated in concert with said gear and coupled to said cylinder.

15. The air compressor assembly according to claim 14, further comprising a piston slidably received in said cylinder and connected to a piston rod, said weight includes a shaft rotatably secured to said base, and includes an eccentric pin secured to said piston rod.

16. The air compressor assembly according to claim 15, wherein said base includes an opening formed therein, and a bearing engaged in said opening of said base, said shaft of said weight is secured to said bearing.

17. The air compressor assembly according to claim 16, wherein said base includes a peripheral flange extended outward therefrom and provided around said opening thereof, and foldable relative to said base for engaging with said bearing and for retaining said bearing in said opening of said base.

18. The air compressor assembly according to claim 13, further comprising a piston slidably received in said cylinder and connected to a piston rod, said second coupling means includes a weight secured to said spindle of said second motor and having an eccentric pin secured to said piston rod.

19. The air compressor assembly according to claim 13, wherein said upper portion of said base includes an aperture formed therein and at least one pair of first holes formed around said aperture of said base for selectively securing said second motor to said upper portion of said base, said lower portion of said base includes an orifice formed therein and at least one pair of second holes formed around said orifice of said base for selectively securing said first motor to said lower portion of said base.

* * * * *